US008245831B2

(12) United States Patent
Holl et al.

(10) Patent No.: US 8,245,831 B2
(45) Date of Patent: Aug. 21, 2012

(54) DEVICE AND METHOD FOR CHECKING BANKNOTES

(75) Inventors: Norbert Holl, Germering (DE); Wolfgang Rapf, München (DE); Helmut Karl Reinisch, München (DE); Dieter Stein, Holzkirchen (DE)

(73) Assignee: Giesecke & Devrient GmbH, Munich (DE)

( * ) Notice: Subject to any disclaimer, the term of this patent is extended or adjusted under 35 U.S.C. 154(b) by 1027 days.

(21) Appl. No.: 11/596,573

(22) PCT Filed: May 17, 2005

(86) PCT No.: PCT/EP2005/005352

§ 371 (c)(1),
(2), (4) Date: Aug. 24, 2007

(87) PCT Pub. No.: WO2005/114596

PCT Pub. Date: Dec. 1, 2005

(65) Prior Publication Data

US 2008/0283451 A1 Nov. 20, 2008

(30) Foreign Application Priority Data

May 18, 2004 (DE) ..... 10 2004 024 620

(51) Int. Cl.
*G07F 7/04* (2006.01)
*B07C 5/00* (2006.01)

(52) U.S. Cl. ..... 194/206; 209/534

(58) Field of Classification Search ..... 194/205, 194/206, 207

See application file for complete search history.

(56) References Cited

U.S. PATENT DOCUMENTS

| | | | | |
|---|---|---|---|---|
| 5,173,590 | A | 12/1992 | Nakano et al. | |
| 5,330,041 | A * | 7/1994 | Dobbins et al. | 194/206 |
| 5,905,810 | A * | 5/1999 | Jones et al. | 382/135 |
| 6,024,202 | A * | 2/2000 | Potter | 194/207 |
| 6,026,175 | A | 2/2000 | Munro et al. | |
| 6,290,070 | B1 | 9/2001 | Graef et al. | |
| 6,305,550 | B1 | 10/2001 | Berz | |
| 6,686,074 | B2 | 2/2004 | Muth et al. | |
| 6,782,986 | B2 * | 8/2004 | Toda et al. | 194/206 |
| 6,868,173 | B1 | 3/2005 | Sakai et al. | |
| 6,981,637 | B2 * | 1/2006 | Nagayoshi et al. | 235/379 |
| 7,092,583 | B2 | 8/2006 | Ahlers et al. | |
| 2002/0043560 | A1 | 4/2002 | Woods et al. | |
| 2002/0130303 | A1 | 9/2002 | Muth et al. | |
| 2002/0131618 | A1 | 9/2002 | Ahlers et al. | |
| 2003/0168849 | A1 | 9/2003 | Reinisch | |
| 2004/0084521 | A1 | 5/2004 | Nagayoshi et al. | |

(Continued)

FOREIGN PATENT DOCUMENTS

| | | | |
|---|---|---|---|
| CN | 1296600 | A | 5/2001 |

(Continued)

*Primary Examiner* — Mark Beauchaine
(74) *Attorney, Agent, or Firm* — Bacon & Thomas, PLLC

(57) ABSTRACT

The invention relates to an apparatus and a method for checking bank notes wherein measuring values of the bank note to be checked are obtained and a classification of the bank note is carried out by evaluation of the measuring values in a plurality of checking steps, whereby the classification distinguishes in particular at least the classification categories, counterfeit, suspect and genuine bank notes, or acceptable or redispensable, and a linkage of a plurality of measuring values is formed at least in one checking step for deciding whether the checked bank note corresponds to a given classification category and this linkage term is compared with a corresponding tolerance range during evaluation.

27 Claims, 2 Drawing Sheets

U.S. PATENT DOCUMENTS

Figure 1:
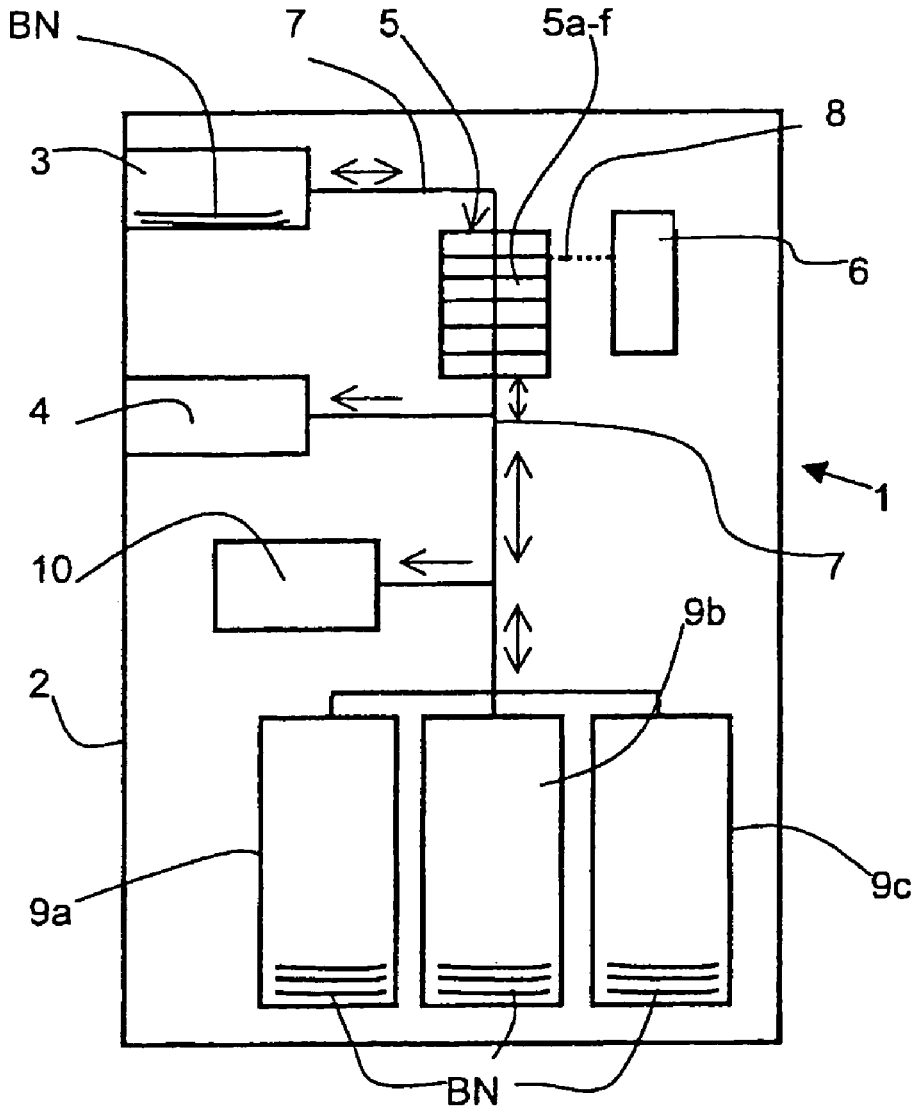

| | | | | |
|---|---|---|---|---|
| 2004/0182677 | A1* | 9/2004 | Katou et al. | 194/206 |
| 2004/0205025 | A1* | 10/2004 | Takeuchi et al. | 705/44 |
| 2005/0011721 | A1* | 1/2005 | Armanini et al. | 194/207 |

FOREIGN PATENT DOCUMENTS

| | | | |
|---|---|---|---|
| CN | 2602434 | Y | 2/2004 |
| DE | 1 002 905 | | 2/1957 |
| DE | 10029051 | A1 | 12/2001 |
| DE | 102 10 689 | | 10/2003 |
| EP | 0553402 | A1 | 8/1993 |
| EP | 0 706 698 | | 4/1996 |
| EP | 1 220 166 | | 7/2002 |
| EP | 1 223 208 | | 7/2002 |
| EP | 1220166 | A1 | 7/2002 |
| EP | 1 241 021 | | 9/2002 |
| EP | 1241021 | A2 | 9/2002 |
| EP | 1349119 | A2 | 10/2003 |
| GB | 2 279 796 | | 1/1995 |
| GB | 2279796 | A | 1/1995 |
| WO | WO95/00932 | | 1/1995 |
| WO | WO 95/00932 | | 1/1995 |
| WO | WO00/33262 | | 6/2000 |
| WO | WO 03/075228 | | 9/2003 |
| WO | WO03/075228 | A1 | 9/2003 |

* cited by examiner

DEVICE AND METHOD FOR CHECKING BANKNOTES

This invention relates to an apparatus and a method for checking bank notes.

EP 0 706 698 A1 discloses for example a machine in which input bank notes are checked for authenticity and redispensability. To accept as many genuine bank notes as possible and not redispense any counterfeits if possible, an input bank note is, in a first checking step, retained as genuine and accepted only if the measuring values from one or more measuring parameters, such as dimension, spectrum or magnetic properties of the bank note, are all within first corresponding acceptance ranges. All other bank notes are directly redispensed by the deposit device. The retained accepted bank notes are then subjected to a second checking step in which it is checked whether the measuring parameters are all also within corresponding second acceptance ranges selected to be narrower than the respective first acceptance ranges. The bank notes that have positively completed both the first and the second checking step and are thus genuine with even greater probability are classified as redispensable and stored in the machine separately from the other bank notes.

It is a disadvantage of this system that an optimal classification result cannot be obtained in all cases.

On these premises, the problem of the present invention is to provide an apparatus and a method for checking bank notes that permit a check of bank notes particularly in automatic teller machines in an effective way.

This problem is solved by the subject matter of the present disclosure.

Thus, since a classification of bank notes into a plurality of categories is carried out, and a linkage of a plurality of measuring values is preferably formed only for some of the checking steps to decide whether the checked bank note corresponds to one of the given classification categories in each case, and is taken into account during the evaluation e.g. by comparison with a corresponding tolerance range, a useful check with increased checking quality can be performed in automatic teller machines and with reduced effort for adaptation of the tolerance ranges.

This approach is of advantage particularly when classification is done at least into the categories "counterfeit", "suspect" and "genuine" and/or classification is done at least into the categories "acceptable" and "redispensable", since in many countries this is a further requirement for use in cash deposit machines and/or combined cash deposit and dispensing machines, so-called recycling machines, in which a customer can deposit stocks of cash in the machine during a transaction, which are credited to an account associated with the depositor and, in a recycling machine, might also be dispensed to another customer in a subsequent transaction.

Although it can be provided that all deposited bank notes retained in an automatic teller machine are classified as "accepted", it can also be provided according to a particularly preferred variant that only those bank notes of said retained bank notes are classified as "accepted" that are moreover also judged as "creditable" and thus credited (possibly temporarily) to an account associated with the depositor.

Thus, in one checking step, e.g. for deciding whether a bank note is to be classified as counterfeit, a linkage term obtained from the measuring values of a plurality of sensor modules of the automatic teller machine can be taken into account during the evaluation, while in another checking step, e.g. for deciding whether a bank note is to be classified as suspect or genuine, at least some or all of the linked measuring values are evaluated singly. The comparison of the individual measuring values with corresponding tolerance ranges e.g. in the check for the category "genuine" permits an evaluation with higher accuracy here than is necessary e.g. in the case of the check for the category "counterfeit", in which a comparison with only one combined term, i.e. the linkage term of a plurality of measuring values, can be sufficiently accurate.

During the check, checking steps are preferably first carried out to decide whether a bank note is to be classified as counterfeit, and only if it is decided that the bank note is not to be classified as counterfeit, further checking steps are carried out to distinguish between genuine and suspect bank notes.

According to this procedure, consequently, all possible checking steps are not first carried out before a decision is made on which of the plurality of classification categories a bank note to be checked is actually assigned to. Only if it is checked and ruled out that the bank note is to be categorized as counterfeit, further checking steps are carried out that permit a distinction between genuine and suspect bank notes.

This procedure of carrying out the check for the category "counterfeit" before the check for the category "suspect" versus "genuine" has the advantage of involving a reduced computing requirement, since relatively great computation effort is required to classify a bank note as either genuine or suspect. Before the check for the category "suspect" versus "genuine", other additional checking steps can preferably be carried out that indicate the category "no recognized bank note".

As mentioned above, the inventive solution further makes it possible particularly effectively to satisfy the criteria to be met in certain countries by the certification of combined deposit and dispensing machines, so-called recycling machines, in which certain bank notes deposited in previous transactions may be redispensed by the same machine in subsequent transactions. Such recycling machines have been known for some time and are described exemplarily e.g. in U.S. Pat. No. 6,290,070 or U.S. Pat. No. 5,173,590.

With regard to the Euro currency area, for example, there are guidelines from the European Central Bank of May 24, 2002, requiring that a deposited bank note must be classified into one of the four categories "no bank note" (category 1), "counterfeit bank note" (category 2), "suspect bank note" (category 3) and "genuine bank note" (category 4), whereas e.g. bank notes recognized as "counterfeit" are not redispensed but must be retained in the machine without being credited to the depositor. Genuine bank notes in good condition, so-called fit bank notes (category 4*a*), can be redispensed from the machine to another depositor in a subsequent transaction, while genuine bank notes in poorer condition, so-called unfit bank notes (category 4*b*), must not be redispensed. The following Table 1 compiles such requirements for the classification of bank notes deposited in an automatic teller machine:

TABLE 1

| Category | 1 (no) | 2 (counterfeit) | 3 (suspect) | 4 (genuine) | |
|---|---|---|---|---|---|
| Condition | — | — | — | 4a (genuine, unfit) | 4b (genuine, fit) |
| Acceptance | no | yes | yes | yes | yes |

TABLE 1-continued

| | | | | | |
|---|---|---|---|---|---|
| Credit | no | no | yes | yes | yes |
| Dispense | no | no | no | no | yes |

The distinction between bank notes categorized as counterfeit, suspect and genuine consists here in the certainty with which the bank notes have been checked as genuine. A bank note classified as "counterfeit" (category 2 in Table 1) has a lower certainty of being genuine than a bank note classified as "suspect" (category 3 in Table 1), and a suspect bank note a lower certainty of being genuine than a bank note classified as "genuine" (category 4 in Table 1). The categories preferably are defined so that not only all genuine bank notes, but also as many soiled bank notes as possible, are classified into category 4.

Unlike a bank note recognized and categorized as "counterfeit", in which e.g. the printed image and format are recognized but other (magnetic, electrical, optical) authentication properties are not within acceptable tolerance ranges, a classification into the category "no bank note" (category 1 in Table 1) is effected e.g. when the tested document cannot be recognized as one of the possible bank notes, because e.g. the wrong currency is checked, the wrong printed image or format is measured, or no recognition is possible due to a multiple feed with overlapping bank notes.

Further, it will preferably be possible to use the evaluation methods as described in the applicant's DE 10029051 A1. Thus, e.g. at least two different authenticity classes each with one or more authenticity criteria can be provided, the individual authenticity classes differing from each other in at least one authenticity criterion. For the authentication check, one authenticity class is selected from the different authenticity classes and the document is checked by the authenticity criteria of the selected authenticity class. The document is assigned to the selected authenticity class if its authenticity criteria are satisfied by the document. The authenticity criteria are for example threshold values or intervals for the authenticity features used for the check. Examples of authenticity features that can be used are optical, magnetic, electrical or physical features, e.g. optical reflection, transmission or emission, magnetic permeability, electrical conductivity, dielectric constant, thickness and format of the document as well as watermarks.

Thus, different authenticity criteria are to be combined into a plurality of authenticity classes during the authentication check of documents, whereas the requirements for authenticity vary in strictness depending on the authenticity class since a different number of authenticity criteria and/or authenticity criteria of varying strictness generally belong to each authenticity class. If, for example, an authenticity class with high requirements for authenticity is selected, e.g. with very high threshold values for optical reflection or transmission, the authenticity of documents that satisfy the authenticity criteria of this selected authenticity class can be affirmed with high probability. Documents that do not satisfy the authenticity criteria of a selected authenticity class can be checked using further selected authenticity classes with lower requirements for authenticity, for example lower threshold values, so that their authenticity can be affirmed with accordingly lower probability. Altogether, this results in a classification of the authentication property, i.e. the authenticity features measured, of the documents to be checked into different authenticity classes. This differentiation of the result of the authentication check permits those documents to be determined that are genuine with a higher probability compared with the prior art authentication check methods, thereby increasing the overall reliability of authentication. At the same time, the remaining documents can still be checked with the hitherto usual—generally "less strict"—authenticity criteria, so that the proportion of genuine documents not recognized as genuine remains low.

In a development of the method it is provided that the condition and/or the denomination of the document is determined, and the authenticity class then selected in dependence on the condition and/or denomination of the document. The denomination is the value or the currency of the document to be checked. The condition of the document is generally given by condition features such as degree of soiling, limpness, defects, such as tears, holes or a defective printed image, as well as alien elements such as adhesive tape. For example, the authenticity class can be selected during the authentication check of a document in dependence on the degree of soiling of the document, whereas clean and undamaged documents can be checked with much stricter authenticity criteria, e.g. higher threshold values, than greatly soiled or damaged documents. This considerably increases the reliability in the counterfeit recognition of clean or slightly soiled documents. Altogether, this condition-dependent authentication check permits documents in very good condition to be identified as genuine or counterfeit with high reliability. Since only the check of documents in very good condition is tightened here, the proportion of genuine documents not recognized as genuine at the same time remains low.

A further aspect of the invention is the use of the idea of DE 10029051 A1 that some of the authenticity criteria used for the authentication check are determined using counterfeit documents. This extends the authentication check with specified authenticity criteria by an additional authentication check with additional authenticity criteria, the additional authenticity criteria being determined using counterfeit documents. The additional authenticity criteria are generally determined in a separate method, e.g. in specially provided devices in which counterfeit documents are examined in particular for characteristic differences compared with genuine documents. The differences found are used for determining additional authenticity criteria which are then supplied to the authentication check method. Documents are still checked here using fixed authenticity criteria and classified as genuine if the authenticity criteria are satisfied. Furthermore, counterfeits can be recognized if the checked documents do not satisfy the additional authenticity criteria determined in known counterfeits, said criteria preferably relating to characteristic differences between a found counterfeit and genuine documents. In this way an increased reliability is obtained in the recognition of counterfeits, in particular with regard to known and circulating counterfeits.

It is particularly emphasized that the subject matter of the various embodiments and the individual features of the description can also be advantageously used independently of the subject matter of each other.

Figure 2:
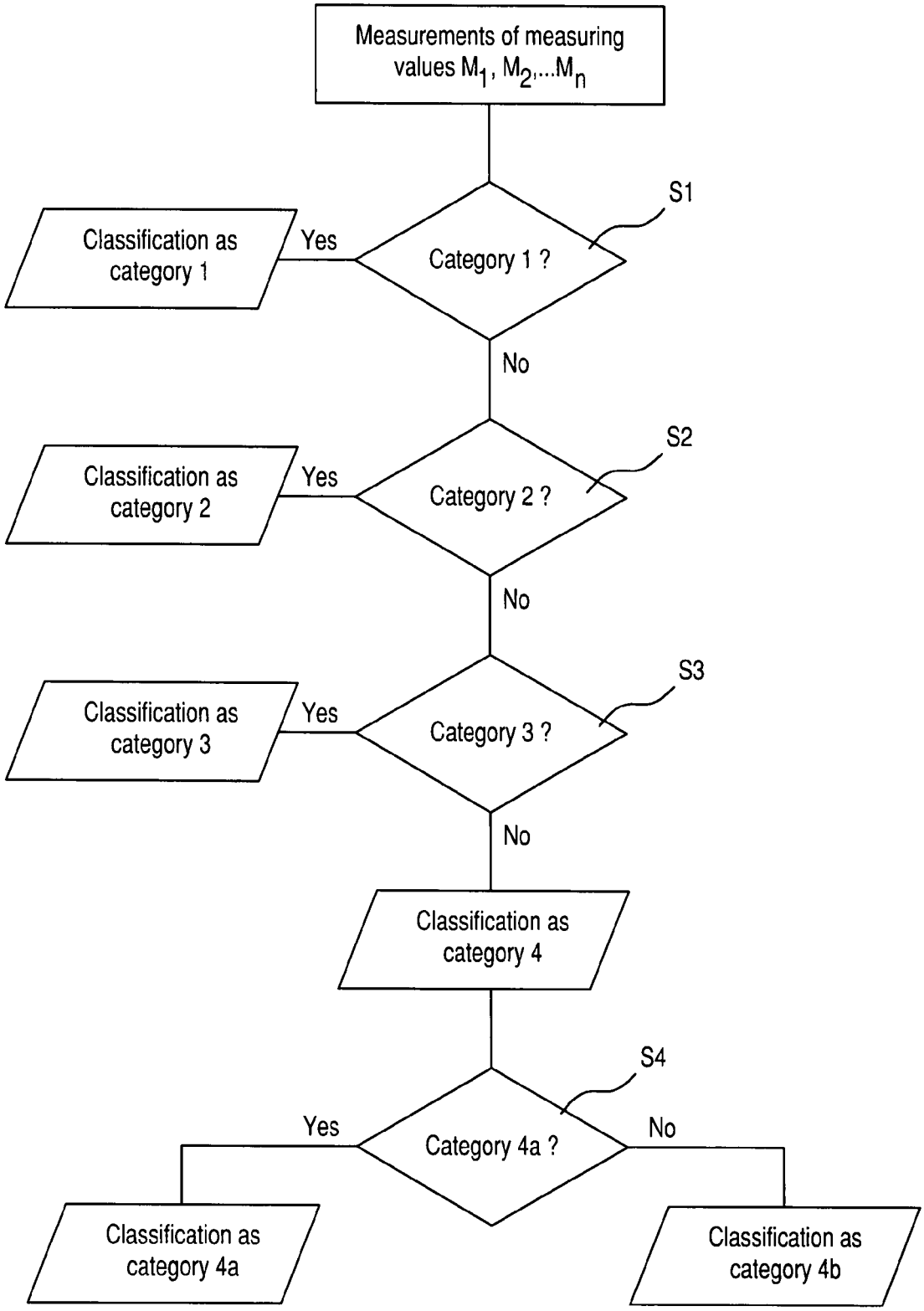

Further advantages and special embodiments of the present invention will be explained and described more closely hereinafter with reference to the enclosed figures. The figures are described as follows:

FIG. 1 a schematic view of a recycling machine according to a first embodiment of the present invention, and FIG. 2 a schematic flow chart to illustrate the present invention.

FIG. 1 shows a schematic view of an example of an inventive combined deposit and dispensing machine 1, also referred to for short as a recycling machine 1.

In the way known in the art, an outwardly accessible input pocket 3 is integrated in the housing 2 of the recycling machine 1 for inputting a stack of bank notes BN to be deposited in a deposit transaction. The bank notes BN input into the input pocket 3 are singled and transported by means of a transport system 7 through a sensor unit 5 in which the authenticity and condition of the bank notes BN are checked. The sensor results are evaluated in a computer-based evaluation unit 6 connected to the sensor unit 5 via a data line 8, and possibly also itself a component of the sensor unit 5. Depending on the results of the evaluation unit 6, gates in the transport system 7 are driven to divert the checked bank note BN into an outwardly accessible output pocket 4 for non-recognized bank notes, one of a plurality of cassettes 9*a-c* for bank notes BN accepted as genuine, or one of optionally a plurality of storage boxes 10 for counterfeit or suspect bank notes. The cassettes 9*a-c* and the storage boxes 10 are not outwardly accessible. The checked bank notes are stored in the cassettes 9*a-c*, separated according to nominal value, in addition to the bank notes BN already prestored therein.

In a dispensing transaction the bank notes BN to be dispensed are singled out of the cassettes 9*a-c* and output by means of the transport system 7 into the output pocket 4. In FIG. 1 the possible transport paths of the bank notes BN are symbolized by arrows.

In a recycling machine 1 bank notes deposited by a customer can thus be retained in a deposit transaction and credited to an account associated with the customer. Moreover, bank notes retained in previous deposit transactions in the same recycling machine 1 can be output in subsequent dispensing transactions, also to another customer, and the dispensed amounts debited to an account associated with this customer.

The recycling machine 1 is characterized particularly by the sensor unit 5 with the associated evaluation unit 6. The sensor unit 5 comprises a plurality of sensor modules 5*a-f* which measure different physical and/or chemical properties of a deposited bank note BN. Although not restricted thereto, the sensor modules 5*a-f* used are by way of example an image sensor module 5*a*, a magnetism sensor module 5*b*, a conductivity sensor module 5*c*, a UV sensor module 5*d* and an IR sensor module 5*e* to permit determination of format, printed image, magnetism, conductivity, absence of brightener, degree of soiling and other aspects of the condition (holes, tears, dog-ears, etc.) of the checked bank notes.

A further independent idea of the present invention is to measure in a recycling machine 1 also the luminescence radiation, particularly preferably both fluorescence radiation and phosphorescence radiation, of feature substances incorporated into the paper or printing ink, as are described e.g. in EP 1 223 208 A1 or EP 1 241 021 A2. It is preferable to measure the intensities and/or intensity ratios of the emission bands or lines and/or their rise and/or decay times in an additional sensor module 5*f* of the sensor unit 5.

Although not restricted thereto, it is preferable to check not only the deposited bank notes but also those dispensed in a dispensing transaction for number, authenticity and/or nominal value once again. This can be effected with either a separate sensor unit or a common sensor unit 5, as shown in FIG. 1 by way of example, whereby both the deposited and the dispensed bank notes pass the sensor unit 5 and are output into the pocket 3 simultaneously also used for manual removal of bank notes, which can be constructed e.g. as described in DE 10210689 A1.

It is possible to measure the luminescence radiation in the sensor module 5*f* both of bank notes BN deposited in an ongoing deposit transaction and of bank notes to be dispensed in an ongoing dispensing transaction. However, the luminescence measurements are preferably carried out only on the bank notes BN deposited in an ongoing deposit transaction and not on the bank notes BN to be dispensed in an ongoing dispensing transaction, which at least partly come from previous deposit transactions, thereby permitting the evaluation of the sensor signals of the sensor unit 5 to be accelerated.

The n measuring values $M_1$ to $M_n$ recorded by said sensor modules 5*a-f* are supplied to the evaluation device 6. The measurements of the individual sensor modules 5*a-f* can also be carried out in time- and/or spatially resolved fashion.

The thus supplied measuring values $M_1$ to $M_n$ of a bank note BN to be checked are then evaluated in a plurality of checking steps by the evaluation unit 6 to be able to obtain statements about the authenticity and condition of the bank note BN. A classification of the deposited bank notes BN is effected here according to the categories shown in Table 1. That is, a deposited bank note BN is classified into one of categories 1 (not recognized), 2 (counterfeit), 3 (suspect) or 4 (genuine), whereby the bank notes BN classified as genuine are also subdivided depending on their condition into the categories 4*a* (fit) or 4*b* (unfit), i.e. judged according to redispensability.

The bank notes not recognized e.g. because of a double feed are immediately returned to the depositor into the output pocket 4, the bank notes categorized as counterfeit or suspect are stored separated from each other in the storage boxes 10, and the genuine bank notes are stored, separated according to nominal value and condition, in the cassettes 9*a-c* so that the category 4*a* bank notes in good condition can be dispensed to other depositors again in subsequent dispensing transactions.

It should be noted, however, that during the classification e.g. a distinction can also be made according to bank notes in good condition, which can e.g. be manually redispensed at a bank counter, and bank notes in very good condition, so-called ATM fit bank notes, which can be redispensed in a machine without any increased risk of jamming.

In simplified fashion, FIG. 2 illustrates an example of the process of classification of a deposited bank note BN, which is designed as a sequential check of the presence of the individual categories. Thus, e.g. one or more checking steps marked S1 are first carried out to decide whether the checked document can be recognized as a bank note BN at all. For this purpose, e.g. measuring values of the image sensor module are evaluated to check the format and/or printed image and/or nominal value of the bank note. Further, e.g. a multiple feed measurement can also be carried out to recognize the presence of overlapping bank notes. Said multiple feed measurement can e.g. likewise be effected by evaluation of optical, or also of magnetic, measuring values. If the measuring values or quantities derived therefrom are not within given tolerance ranges, e.g. because the format is wrong or the nominal value cannot be clearly determined, the bank note is classified as a category 1 and output into the output pocket 4 after running through the sensor unit 5.

To judge whether a measuring value or other quantity is within a given tolerance range according to the present invention, the measuring value is e.g. compared with an upper and/or lower threshold value.

Only if it is ascertained in the checking step S1 that the bank note BN to be checked is not a category 1 bank note, one or more further checking steps S2 are carried out to check whether the bank note BN is a category 2, i.e. counterfeit, bank note. These can be e.g. bank notes in which e.g. properties such as the printed image and format are correct, properties that can be imitated well with usual color copies, but other authentication properties, such as measuring values for optical, specifically IR or UV, properties, magnetism or electrical properties or quantities derived therefrom are outside given wide tolerance ranges.

Only if it is ascertained in the checking step S2 that the bank note BN to be checked is not a category 2 bank note either and has thus been judged "acceptable", i.e. capable of being accepted and credited to an account, one or more further checking steps S3 are carried out to check whether the bank note BN is a category 3, i.e. suspect, bank note, in which e.g. the above-mentioned or other measuring values for optical, specifically IR or UV, properties, magnetism or electrical properties or the above-mentioned or other quantities derived therefrom are outside corresponding, e.g. narrower, tolerance ranges. This category 3 can include not only sophisticated counterfeits but also those actually genuine bank notes in which at least some of the measuring values, e.g. due to great soiling, are outside the tolerance ranges usual for non-soiled or normally soiled bank notes.

Finally, all remaining bank notes which could not be classified into any of categories 1 to 3 and therefore belong to category 4 are checked for their condition and thus for redispensability from the machine 1. For this purpose, it is ascertained in one or more checking steps S4 e.g. whether the degree of soiling of the bank note BN and/or the number, distribution or size of holes, tears, dog-ears or the like are within given tolerance ranges. If so, the bank note BN is classified as redispensable, i.e. category 4*a*, stored in one of the cassettes 9*a-c* associated with the nominal value, and can be redispensed in subsequent transactions. Otherwise, the bank note is classified as non-redispensable, i.e. category 4*b*, and retained separately in the machine 1 and not redispensed from the machine 1 in subsequent transactions.

According to a further idea, it can be provided that different properties are checked in different checking steps for classification of the bank note. Accordingly, no measuring value or no properties are preferably checked in the two checking steps. Thus, e.g. an evaluation of the magnetism or infrared measuring values will only be carried out in the checking step S3 to distinguish between suspect and genuine bank notes BN.

Further, it can be provided that the measuring values for a bank note property are only compared with a single corresponding tolerance range in each case during a check of a bank note BN to decide whether the measuring value is to be judged as positive or negative. For a checking step e.g. on the acceptability of the bank note or in the stated example e.g. in the checking step S2, e.g. only a smaller number of positive measuring value checks is then required than for a subsequent checking step 3 or 4. Assuming ten different measuring values altogether, only four measuring value checks for example must turn out positive to judge the bank note in the device as acceptable, i.e. category 3 or 4, while at least six positive measuring value checks are necessary to judge the bank note as genuine, i.e. as a category 4.

Analogously, a larger number of negative measuring value checks can be required e.g. for the checking step on the acceptability of the bank note than for a subsequent checking step. Assuming ten different measuring values altogether, for example seven measuring value checks must turn out negative to judge the bank note in the machine 1 as definitely counterfeit, i.e. category 2, while four to six negative measuring value checks are necessary to judge the bank note as suspect, i.e. category 3, while no negative measuring value check may occur to judge the bank note as clearly genuine, i.e. as category 4.

It is preferable here to consider measuring values on different measuring properties and in particular also from different sensor modules 5*a-f*.

In this method a different weighting can also be carried out, e.g. according to a different weighting factor of the individual measuring value checks, to make it possible to distinguish important from less important measurements during evaluation. For the judgment of redispensability or in step S2 of the check for category 2, e.g. a higher total score is then required again, corresponding to the sum of the scores of all positively and/or negatively checked measuring values, than for the judgment of acceptability of the bank note or in step S3 of the check for category 3.

It is emphasized that, in this as well as the other embodiments, quantities derived from the measuring values can always be used in the evaluation instead of the measuring values.

Further, as in the previous embodiment, e.g. the measuring values or quantities derived therefrom, corresponding to the measurement of a certain physical property of the bank note, can also be distinguished into different importance categories. Thus, e.g. the measuring values of easily forgeable properties, such as optical measuring values recorded in the visible frequency domain or also electrical measuring values, are categorized as less important than e.g. the optical measuring values recorded in the non-visible frequency domain or the magnetic measuring values, which are more difficult to forge. It is e.g. also possible to rate the measuring values of the individual sensor modules 5*a-f* as varying in importance. For a checking step such as the acceptance check of a bank note or in step S2 of the check for category 2, e.g. only the positive measurement of a less important property will then suffice, while for redispensability or in step S3 of the check for category 3, at least one important property must necessarily also be tested positive.

Instead of comparing single measuring values singly with given tolerance ranges in each case, a linkage of a plurality of measuring values is alternatively formed during evaluation, according to another idea of the present invention, and this linkage term compared with a separate tolerance range during the evaluation of at least one checking step. The linkage of the plurality of measuring values can be e.g. a multiparametric mathematical function which forms e.g. the minimum and/or maximum and/or an average and/or the ratio and/or a linear combination of the measuring values to be linked. In one of the plurality of checking steps a linkage term is then formed from a plurality of measuring values e.g. with the help of a fuzzy logic, and compared with a corresponding tolerance range. Said linkage term will preferably be a derived quantity which depends on measuring values of different physical or chemical properties or different sensor modules 5*a-f*, e.g. both on the magnetism and on the optical properties of the checked bank note.

A linkage term linking such a plurality of different measurands will preferably be used in checking step S2 for distinguishing counterfeit from suspect bank notes, while in a second checking step S3, i.e. for distinguishing suspect from genuine bank notes BN, the single non-linked measuring values, or quantities derived therefrom, are then again compared singly with corresponding tolerance ranges.

This approach has the advantage of permitting a better-quality check, so that the acceptance check involving lower requirements for clear detection of the authenticity of the bank notes, or the check for category 2, can be carried out more easily than the check for actual authenticity and/or redispensability requiring a high degree of certainty, i.e. the checks for category 3 and 4.

According to yet another idea of the present invention, a mutual correlation of a plurality of measuring values is checked in one of the checking steps, e.g. by carrying out a ratio formation of a plurality of measuring values. If measuring values of the same bank note property and/or the same sensor module 5*a-f* are evaluated here, this can consist, e.g. when measuring magnetism in different places of the bank note area, in not comparing the absolute values of magnetism in different places with a corresponding tolerance range in each case, but checking in at least one of the checking steps only whether the ratio of measured magnetism values in different places is within a given tolerance range characteristic of genuine bank notes.

Further, it can be provided additionally or alternatively that in one checking step a measuring value is normalized by at least one other measuring value which preferably comes from another bank note property measurement and/or another sensor module 5*a-f*. Thus, e.g. an optical measuring value particularly characteristic of authenticity, e.g. recorded in the non-visible frequency domain, or a magnetic measuring value can be normalized by another measuring value characteristic of condition. In one of the checking steps e.g. the measuring values of the magnetic sensor module can accordingly be normalized in dependence on pressure intensity to permit e.g. also the condition of the bank note to be taken into account, which can lead for example to a reduction of magnetism measuring values in washed out bank notes.

Moreover, it can be provided that in one checking step, e.g. step S2, only the sheer presence of a bank note property is checked, while in a second checking step involving a higher requirement for the accuracy of the authentication check, e.g. step S3, the exact position or structure of the bank note property is determined. Here it is checked e.g. whether the distribution of magnetic substances in the bank note paper corresponds to the expected distribution.

Accordingly, the different type of check in two checking steps can also consist e.g. in ascertaining in a first checking step whether a bank note has a given spatial coding of an e.g. magnetic, optical or electrical property. This means that it is checked e.g. whether magnetism has a given spatial distribution, an optical bar code is present with a given structure, or the security thread has a given magnetic or electrical coding as are to be expected in genuine bank notes. In another checking step, the individual measuring values of the coded property are then compared with corresponding individual and preferably different tolerance ranges to be able to obtain statements about whether the coding is present with the right intensity behavior e.g. in the case of fixed differences of the individual measuring values of the coding in different places on the bank note.

Further, it is e.g. also possible to carry out a spatially resolved measurement in one checking step and a non-spatially resolved measurement in another checking step. If e.g. measuring values on magnetism in different places on the bank note area are recorded by means of the magnetism sensor module 5*b*, only an average of different recorded magnetism measuring values, which is a measure of the averaged magnetism behavior of the bank note BN, can be formed e.g. to check the acceptance or for category 2 of input bank notes, while only in the second step, in which e.g. genuine and suspect bank notes are distinguished or redispensability is checked, the individual magnetism measuring values are compared with individual corresponding tolerance ranges in each case to be able to make statements about the magnetism in different places on the bank note, such as in the security thread, the serial number or the printed image.

If condition terms, such as measuring values on dog-ears, holes and/or tears, are also taken into account in the evaluation, it is accordingly possible e.g. to check and compare with given tolerance ranges in one checking step only a sum measuring value in each case as a measure of the total area of all measured dog-ears, holes and/or tears, and in another, preferably subsequent, checking step the size of the largest dogear, hole or tear in each case.

It is emphasized that the inventive apparatus can also be used in a cash deposit machine without a redispensing functionality. If a check for redispensability is to be effected, the corresponding checking steps can also be carried out in this case and the bank notes distinguished according to redispensable or non-redispensable then stored separately or marked for a later post-processing without being able to be output again from the machine itself.

The invention claimed is:

1. A method for checking bank notes in a bank note checking apparatus comprising the following steps:

obtaining measuring values of the bank note to be checked and performing a classification of the bank note, wherein the classification distinguishes at least the classification categories selected from the group consisting of counterfeit, suspect, and genuine bank notes, wherein the classification performs an evaluation of the measuring values in a plurality of checking steps;

wherein, of the plurality of checking steps, checking steps are first performed to decide whether a bank note is to be classified as counterfeit, and only if it is decided that the bank note is not to be classified as counterfeit, further checking steps are carried out to distinguish between genuine and suspect bank notes; and wherein at least in one of the plurality of checking steps for deciding whether the checked bank note corresponds to a given classification category, a linkage of a plurality of measuring values is formed and this linkage term is evaluated.

2. The method according to claim 1, wherein the checking steps are effected in an automatic teller machine with a bank note deposit functionality and the deposited bank notes are classified.

3. The method according to claim 1, wherein the classification further distinguishes either or both of the classification categories, acceptable and redispensable.

4. The method according to claim 1, wherein in another checking step for deciding whether the checked bank note corresponds to another given classification category, at least some or all of the linked measuring values are evaluated singly.

5. The method according to claim 1, wherein the plurality of measuring values measure different properties of the bank note and/or measure the same property in different places on the bank note and/or are obtained from different sensor modules.

6. The method according to claim 1, wherein in checking steps for deciding whether the checked bank note corresponds to a given classification category, a spatially resolved measurement is carried out and taken into account in the decision, and in another checking step for deciding whether the checked bank note corresponds to another given classification category, a non-spatially resolved measurement is carried out and taken into account in the decision.

7. The method according to claim 1, wherein both bank notes classified as counterfeit and bank notes classified as suspect are retained in the bank note checking apparatus and are not redispensed.

8. The method according to claim 1, wherein bank notes classified as genuine are distinguished according to non-redispensable and redispensable bank notes.

9. The method according to claim 1, wherein one or more measuring values are compared in different checking steps with tolerance ranges varying in narrowness to be able to perform a distinction between counterfeit and suspect bank notes and/or between suspect and genuine bank notes.

10. The method according to claim 1, wherein each measuring value is compared with only a tolerance range corresponding to the measuring value during evaluation.

11. The method according to claim 1, wherein, for classifying a bank note to be checked as a redispensable bank note, additional checking steps are performed than for classifying a bank note to be checked as a genuine bank note.

12. The method according to claim 1, wherein the linkage of the plurality of measuring values is a multiparametric mathematical function which forms a minimum and/or maximum and/or an average and/or the ratio and/or a linear combination of the measuring values to be linked.

13. The method according to claim 1, wherein the measuring values to be linked are obtained in different places on the bank note to be checked.

14. The method according to claim 1, wherein in first and second different checking steps for deciding whether the checked bank note corresponds to first and second given classification categories, respectively, a different linkage of a plurality of measuring values, is formed and taken into account in the respective decision.

15. The method according to claim 1, wherein a plurality of measuring values are compared with a corresponding tolerance range in each case, wherein the individual measuring value is rated positively checked when the particular measuring value is within the corresponding tolerance range, and for a first checking step for deciding whether the checked bank note corresponds to a given classification category, a different ratio of positive and/or negative measuring value checks is required than for a second checking step for deciding whether the checked bank note corresponds to another given classification category.

16. The method according to claim 15, wherein a different weighting of different measuring value checks is carried out in the check of the ratio of positive and/or negative measuring value checks.

17. The method according to claim 1, wherein it is decided in a checking step that the checked bank note corresponds to the given classification category only if one or more given determined measuring values of the bank note are checked positively or negatively.

18. The method according to claim 1, wherein a decision is made on a classification of the bank note as acceptable in one or more checking steps, and a decision is made on a classification of the bank note as redispensable in one or more other checking steps.

19. The method according to claim 1, wherein a decision is made on a classification of the bank note as counterfeit in one or more checking steps, and a decision is made on a classification of the bank note as suspect in one or more other checking steps, and/or a decision is made on a classification of the bank note as suspect in one or more checking steps, and a decision is made on a classification of the bank note as redispensable in one or more other checking steps.

20. The method according to claim 1, wherein the measuring values are obtained from different sensor modules of the bank note checking apparatus and/or measure different properties of the bank note to be checked.

21. The method according to claim 1, wherein after the checking step to determine whether a bank note is to be classified as counterfeit, if the bank note is not to be classified as counterfeit, a further checking step is performed to determine if the bank note is suspect of being counterfeit.

22. An apparatus for checking bank notes comprising a sensor unit arranged to obtain measuring values of the bank note to be checked and an evaluation device arranged to evaluate the measuring values to carry out a classification of the bank notes, wherein the apparatus is arranged for checking bank notes in a bank note checking apparatus by:

obtaining measuring values of the bank note to be checked and performing a classification of the bank note, wherein the classification distinguishes at least the classification categories selected from the group consisting of counterfeit, suspect, and genuine bank notes, wherein the classification performs an evaluation of the measuring values in a plurality of checking steps;

wherein, of the plurality of checking steps, checking steps are first performed to decide whether a bank note is to be classified as counterfeit, and only if it is decided that the bank note is not to be classified as counterfeit, further checking steps are carried out to distinguish between genuine and suspect bank notes; and wherein at least in one of the plurality of checking steps for deciding whether the checked bank note corresponds to a given classification category, a linkage of a plurality of measuring values is formed and this linkage term is evaluated.

23. The apparatus according to claim 22, wherein the apparatus comprises a deposit machine or a recycling machine.

24. The apparatus according to claim 23, wherein the apparatus has an input pocket for inputting bank notes to be checked and one or more storage areas for storing the checked bank notes.

25. The apparatus according to claim 22, wherein after the checking step to determine whether a bank note is to be classified as counterfeit, if the bank note is not to be classified as counterfeit, a further checking step is performed to determine if the bank note is suspect of being counterfeit.

26. An apparatus for checking bank notes comprising a sensor unit for obtaining measuring values of the bank note to be checked and an evaluation device for evaluating the measuring values, to carry out a classification of the bank notes, wherein the classification distinguishes at least the classification categories selected from the group consisting of counterfeit, suspect, and genuine bank notes, wherein the classification performs an evaluation of the measuring values in a plurality of checking steps;

wherein, of the plurality of checking steps, checking steps are first performed to decide whether a bank note is to be classified as counterfeit, and only if it is decided that the bank note is not to be classified as counterfeit, further checking steps are carried out to distinguish between genuine and suspect bank notes; and wherein the apparatus comprises a recycling machine, and the sensor unit has a sensor module for measuring the luminescence radiation of feature substances incorporated into the paper or the printing ink of the bank note.

27. The apparatus according to claim 26, wherein both deposited and dispensed bank notes are checked by the sensor unit, and/or the luminescence radiation of feature substances incorporated into the paper or the printing ink is measured by the sensor module only in deposited and not in dispensed bank notes.

* * * * *